US005476024A

United States Patent [19]

Hsieh

[11] Patent Number: 5,476,024

[45] Date of Patent: Dec. 19, 1995

[54] SLEEVE MODULE FOR CO-OPERATING WITH A RATCHET WRENCH

[76] Inventor: Chih-Ching Hsieh, No. 64, Lane 107, Lian Tsun Rd., Feng Yuan City, Taichung Hsien, Taiwan

[21] Appl. No.: 345,606

[22] Filed: Nov. 28, 1994

[51] Int. Cl.[6] ..... B25B 13/06

[52] U.S. Cl. ..... 81/121.1; 81/186

[58] Field of Search ..... 81/119, 121.1, 81/186

[56] References Cited

U.S. PATENT DOCUMENTS 5,117,714 6/1992 Pagac et al. ..... 81/121.1 X

*Primary Examiner*—James G. Smith
*Attorney, Agent, or Firm*—Welsh & Katz, Ltd.

[57] ABSTRACT

A sleeve module includes a hexagonal recess longitudinally defined by six sides of the sleeve module, any two adjacent sides of the six sides of the sleeve module being alternately formed with a support side and an urging side, a protruding portion formed on each of the support sides and extending radially and inwardly therefrom, each of the urging sides having a first end portion and a second end portion, a plurality of first teeth formed on the first end portion of each of the urging sides and facing toward an adjacent support side, a plurality of second teeth formed on the second end portion of associated urging side and facing oppositely to the plurality of first teeth.

6 Claims, 3 Drawing Sheets

SLEEVE MODULE FOR CO-OPERATING WITH A RATCHET WRENCH

BACKGROUND OF THE INVENTION

1. Field of Invention

The present invention relates to a sleeve module, and more particularly to a sleeve module for co-operating with a ratchet wrench.

2. Related Prior Art

Conventional sleeve modules for co-operating with a ratchet wrench are shown in FIGS. 5 and 6. However, by such an arrangement, there are still some shortcomings in the conventional sleeve modules.

There will be a more complete and sufficient illustration in the detailed description of the preferred embodiments, concerning the conventional sleeve modules.

The present invention has arisen to mitigate and/or obviate the above-mentioned disadvantages of the conventional sleeve modules.

SUMMARY OF THE INVENTION

The primary objective of the present invention is to provide a sleeve module for co-operating with a ratchet wrench.

In accordance with one aspect of the present invention, there is provided a sleeve module comprising a hexagonal recess being longitudinally defined by six sides of the sleeve module, any two adjacent sides of the six sides of the sleeve module being alternately formed with a support side and an urging side, a protruding portion formed on each of the support sides and extending radially and inwardly therefrom, each of the urging sides having a first end portion and a second end portion, a plurality of first teeth formed on the first end portion of each of the urging sides and facing toward an adjacent support side, a plurality of second teeth formed on the second end portion of associated the urging side and facing oppositely to the plurality of first teeth.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 5:
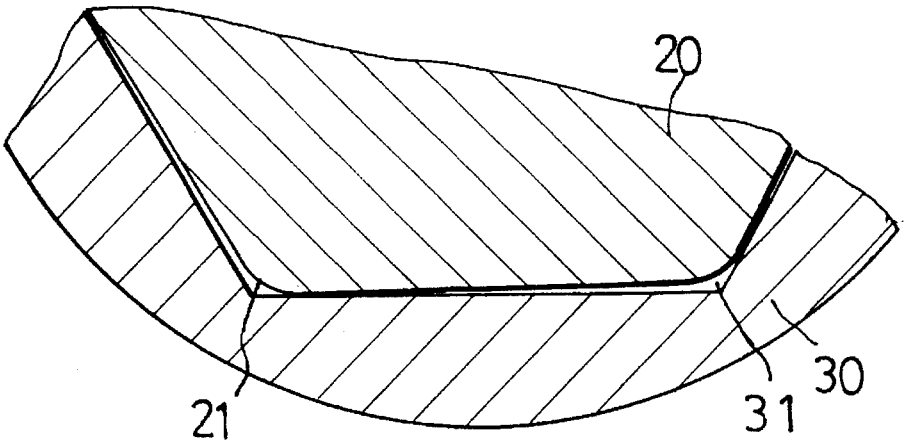
FIG. 5 is a partially cross-sectional view of a first conventional sleeve module in accordance with the prior art to be rotated clockwise relative to a hexagonal element.

Referring to FIG. 5, a first conventional sleeve module 30 in accordance with the prior art is partially shown and comprises a hexagonal recess 31 longitudinally defined by six sides, a hexagonal element 20 received in the recess 31 of the sleeve module 30 and comprising six sides (not labeled) having an equal length to be operated by the sides sleeve module 30 and comprising six corners 21. When the sleeve module 30 is driven to rotate clockwise relative to the hexagonal element 20, each of the sides of the sleeve module 30 is urged against a corresponding corner 21 of the hexagonal element 20 essentially by single-point contact such that the corners 21 are easily rounded or worn out during long-term utilization, so being apt to cause a sliding motion of the hexagonal element 20 relative to the sleeve module 30.

Figure 6:
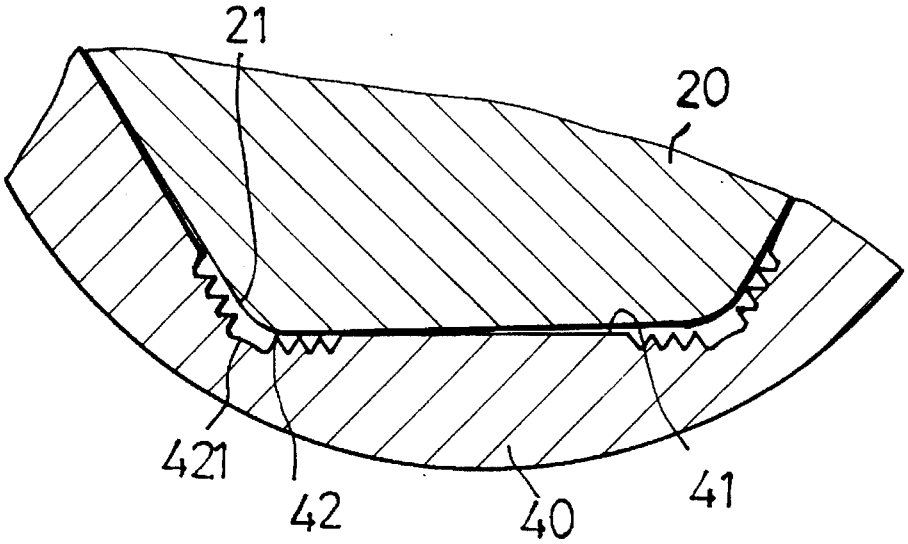
FIG. 6 is a partially cross-sectional view of a second conventional sleeve module in accordance with the prior art to be rotated clockwise relative to a hexagonal element.

Referring to FIG. 6, a second conventional sleeve module 40 in accordance with the prior art is partially shown and comprise a hexagonal recess 41 longitudinally defined by six sides, six corners 421 each respectively mounted between any two adjacent sides of the sleeve module 40, a plurality of teeth 42 formed adjacent to a corresponding one of the six corners 421 of the sleeve module 40, a hexagonal element 20 received in the recess 41 of the sleeve module 40 and comprising six sides (not labeled) having an equal length to be operated by the sides sleeve module 40 and comprising six corners 21. When the sleeve module 40 is driven to rotate clockwise relative to the hexagonal element 20, the plurality of teeth 42 of the sleeve module 40 is urged against a corresponding corner 21 of the hexagonal element 20 essentially by multi-point contact, thereby providing an efficient purchase effect on each side for securely positioning the hexagonal element 20. By such an arrangement, the hexagonal element 20 is entirely supported and urged by means of the plurality of teeth 42, so easily deforming or distorting the corners 21 of the hexagonal element 20.

Figure 1:
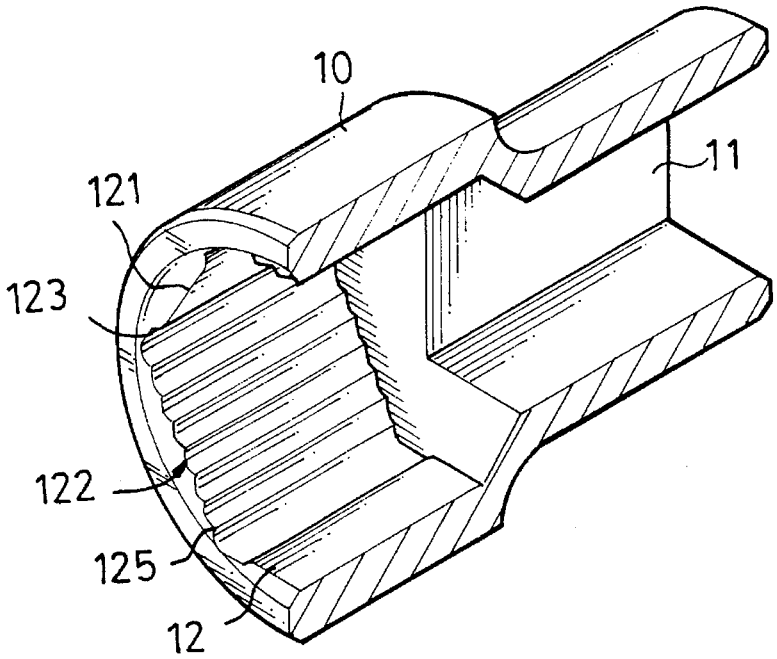
FIG. 1 is a perspective cross-sectional view of a sleeve module in accordance with the present invention.
Figure 2:
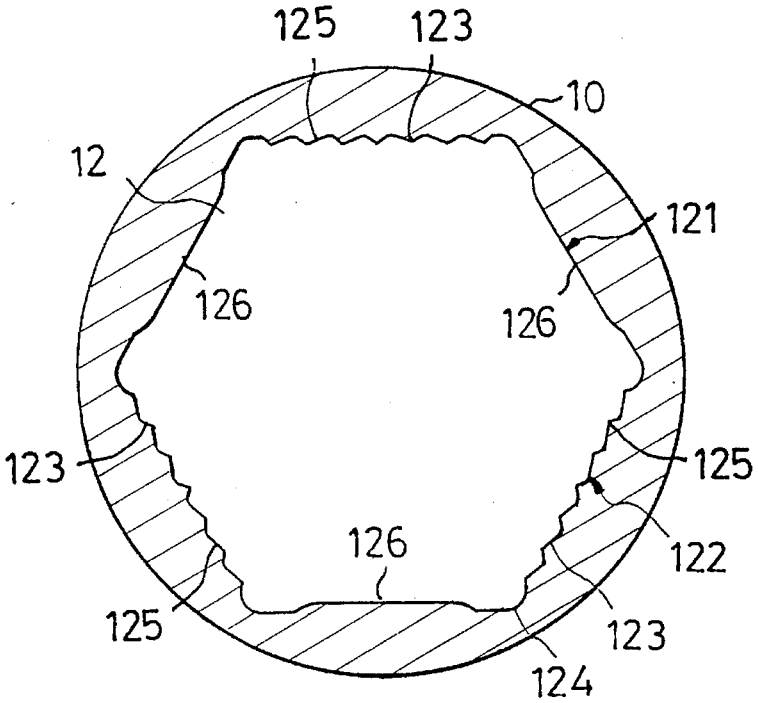
FIG. 2 is a front cross-sectional view of the sleeve module as shown in FIG. 1.
Figure 3:
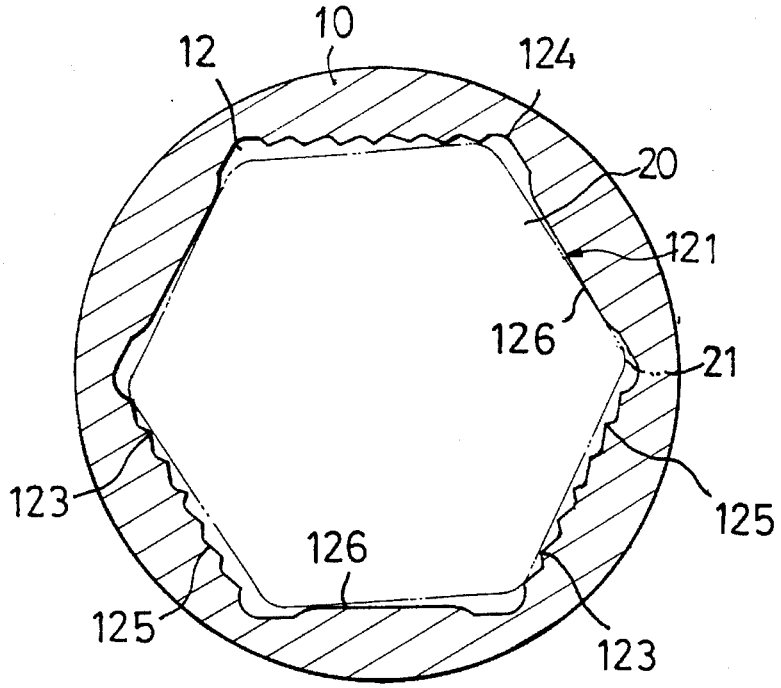
FIG. 3 is an operational view showing the sleeve module being rotated clockwise relative to a hexagonal element.

Referring to FIGS. 1–3, a sleeve module 10 in accordance with the present invention is provided for co-operating with a ratchet wrench (not shown) which comprises a tetragonal stub (not shown), a tetragonal recess 11 being longitudinally defined in the sleeve module 10 and being dimensioned to receive the tetragonal stub of the ratchet wrench therein such that the sleeve module 10 is driven by the ratchet wrench. The sleeve module 10 comprises a hexagonal recess 12 longitudinally defined by six sides of the sleeve module 10, any two adjacent sides of the six sides of the sleeve module 10 being alternately formed with a support side 121 and an urging side 122, six corners 124 each respectively formed between the support side 121 and adjacent urging side 122, a protruding portion 126 formed on each of the support sides 121 and extending radially and inwardly therefrom, each of the urging sides 122 having a first end portion and a second end portion, a plurality of first teeth 123 formed on the first end portion of each of the urging sides 122 and facing toward an adjacent support side 121, a plurality of second teeth 125 formed on the second end portion of associated the urging side 122 and facing oppositely to the plurality of first teeth 123.

Preferably, the plurality of first and second teeth 123 and 125 intersect at a mediate portion of the urging side 122. A hexagonal element 20 such as a nut, a bolt head and the like, having six sides which are of an equal length is received in the hexagonal recess 12 to be operated by the sleeve module 10, the protruding portion 126 is formed on a mediate portion of each of the support sides 121 for biasing against a mediate portion of a corresponding one side of the hexagonal element 20 and has a length substantially equal to one half of the length of one side of the hexagonal element 20.

Figure 4:
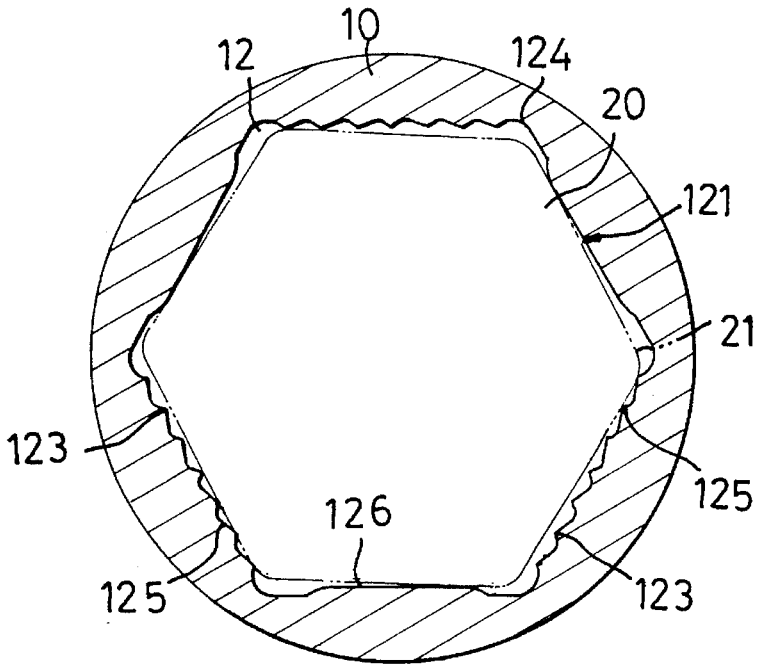
FIG. 4 is an operational view showing the sleeve module being rotated counterclockwise relative to a hexagonal element.

In operation, referring to FIG. 3, the sleeve module 10 is driven by the ratchet wrench Go be rotated clockwise relative to the hexagonal element 20 in the hexagonal recess 12 with each of the protruding portions 126 biasing against a corresponding one of the sides of the hexagonal element 20 while each of the plurality of first teeth 123 is securely urged against a corresponding one of the sides of the hexagonal element 20, thereby providing an efficient purchase effect on the sides for securely positioning the hexagonal element 20, so avoiding a sliding motion thereof even during long-term utilization- Now, referring to FIG. 4, the sleeve module 10 is driven by the ratchet wrench to be rotated counterclockwise relative to the hexagonal element 20 in the hexagonal recess 12 with each of the protruding portions 126 still biasing against a corresponding one of the sides of the hexagonal element 20 while each of the plurality of second teeth 125 is securely urged against a corresponding one of the sides of the hexagonal element 20, thereby providing an efficient purchase effect on the sides for securely positioning the hexagonal element 20, so, avoiding a sliding motion thereof even during long-term utilization. Preferably, the hexagonal element 20 has six corners 21 each respectively received in a corresponding one of the corners 124 of the sleeve module 10.

Accordingly, a sleeve module in accordance with the present invention has the following advantages and benefits:

(1) The teeth of each of the urging sides are urged against each side of the hexagonal element essentially by multi-point contact, thereby providing an efficient purchase effect on each side for securely positioning the hexagonal element, so avoiding a sliding motion thereof even during long-term utilization and preventing deforming the corners of the hexagonal element.

(2) The protruding portions are not in contact with the corners of the hexagonal element, so avoiding deforming or distorting the corners thereof such that the hexagonal element is not easily worn out.

It should be clear to those skilled in the art that further embodiments of the present invention may be made without departing from the teachings of the present invention.

What is claimed is:

1. A sleeve module (10) comprising a hexagonal recess (12) longitudinally defined by six sides of said sleeve module (10), any two adjacent sides of said six sides of said sleeve module (10) being alternately formed with a support side (121) and an urging side (122), a protruding portion (126) formed on each of said support sides (121) and extending radially and inwardly therefrom, each of said urging sides (122) having a first end portion and a second end portion, a plurality of first teeth (123) formed on said first end portion of each of said urging sides (122) and facing toward an adjacent support side (121), a plurality of second teeth (125) formed on said second end portion of associated said urging side (122) and facing oppositely to said plurality of first teeth (123).

2. The sleeve module in accordance with claim 1, wherein said sleeve module (10) is provided for co-operating with a ratchet wrench which comprises a tetragonal stub, a tetragonal recess (11) being longitudinally defined in said sleeve module (10) and being dimensioned to receive said tetragonal stub of said ratchet wrench therein.

3. The sleeve module in accordance with claim 1, wherein six corners (124) each are respectively formed between said support side (121) and adjacent said urging side (122).

4. The sleeve module in accordance with claim 1, wherein said plurality of first and second teeth (123) and (125) intersect at a mediate portion of said urging side (122).

5. The sleeve module in accordance with claim 1, wherein a hexagonal element (20) is received in said hexagonal recess (12) to be operated by said sleeve module (10), said protruding portion (126) being formed on a mediate portion of each of said support sides (121) for biasing against a mediate portion of a corresponding side of said hexagonal element (20).

6. The sleeve module in accordance with claim 5, wherein each of said protruding portions (121) has a length substantially equal to one half of the length of one side of said hexagonal element (20).

* * * * *